US007484299B1

(12) United States Patent
Fleming

(10) Patent No.: US 7,484,299 B1
(45) Date of Patent: Feb. 3, 2009

(54) ADJUSTABLE FOOD SERVING UTENSIL

(76) Inventor: Christian Fleming, 2240 Shelterwood Rd., Birmingham, AL (US) 35226

( * ) Notice: Subject to any disclaimer, the term of this patent is extended or adjusted under 35 U.S.C. 154(b) by 0 days.

(21) Appl. No.: 11/531,945

(22) Filed: Sep. 14, 2006

(51) Int. Cl.
*A47J 43/28* (2006.01)

(52) U.S. Cl. ..... 30/141; 30/142; 30/150; 30/324; 30/325

(58) Field of Classification Search ..... 30/141, 30/142, 324, 325, 122, 150, 137, 147, 322, 30/326, 327; D7/653, 664, 401.2, 643
See application file for complete search history.

(56) References Cited

U.S. PATENT DOCUMENTS

| | | | | | |
|---|---|---|---|---|---|
| 510,286 | A | * | 12/1893 | Osterman | 30/128 |
| 1,351,045 | A | * | 8/1920 | Larson | 30/122 |
| 2,255,052 | A | * | 9/1941 | Oscar | 30/140 |
| 2,650,425 | A | * | 9/1953 | Brandel | 30/325 |
| 4,005,310 | A | * | 1/1977 | Baisch | 219/227 |
| D248,143 | S | | 6/1978 | Cannon et al. | |
| D250,628 | S | | 12/1978 | Seibel | |
| D284,342 | S | | 6/1986 | Campbell | |
| 4,835,864 | A | * | 6/1989 | Tang | 30/150 |
| D307,095 | S | | 4/1990 | Juergens | |
| 4,993,156 | A | | 2/1991 | Craven | |
| D352,641 | S | | 11/1994 | Coquereau et al. | |
| D482,939 | S | | 12/2003 | Daenen et al. | |
| 6,851,574 | B1 | * | 2/2005 | Traynor | 222/1 |

* cited by examiner

*Primary Examiner*—Boyer D Ashley
*Assistant Examiner*—Omar Flores-Sánchez

(57) ABSTRACT

A food serving utensil includes a body that has a handle located at a proximal end and a food retaining section located at a distal end respectively. A hollow chamber extends from the proximal end to the distal end of the body and is axially seated therein. A linear opening is located adjacent to the proximal end. An actuator switch is housed within the linear opening and linearly displaced parallel to a longitudinal length thereof. The switch has a flange portion protruding outwardly from a top surface of the handle. A shaft is housed within the chamber and extends along a longitudinal length thereof. The shaft has a first end monolithically formed with the switch and a second end intercalated within the food retaining section. A stabilizing mechanism is spaced from the food retaining section and is engaged with the shaft and the body.

4 Claims, 7 Drawing Sheets

ADJUSTABLE FOOD SERVING UTENSIL

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to serving utensils, and more particularly, to an adjustable food serving utensil for use with solid and liquid foods.

2. Prior Art

In the preparation and serving of appetizers, main entrees and desserts, the food products used in the recipes for these dishes are removed from their original packaging. For instance, various condiments, dressings, sauces and other liquids, as well as granular or powder substances (e.g. sugar, flour, salt, etc.) are removed from their original packaging and placed into bowls, dishes, pans, etc. in the process of preparation and serving of various recipe dishes.

One prior art example shows a utensil for scooping, scraping, measuring, pouring and serving that includes a main body having a generally flat bottom and side walls extending up from the bottom to a top edge in surrounding relation to an interior reservoir. The top edge is preferably tapered in thickness to provide a scraping blade which generally conforms to and seals against the surface of a bowl, dish, pan or the like to thoroughly scrape and remove a substance therefrom. A pour spout formed with a non-drip lip extends from one of the side walls, along the top edge, and allows the scooped substance to be easily poured into a storage container without spilling the substance. A handle extends from the main body and, in a preferred embodiment, is offset towards the pour spout side to reduce the likelihood of contact of the user's fingers with the substance when the top edge opposite of the spout is used to scrape and scoop the substance. Unfortunately, this prior art example does not provide a means for draining fluids from food stuffs contained within the serving section of the spoon.

Another prior art example shows a combination-material food utensil constructed of materials having different relative hardness. The skeleton or backbone of the utensil is constructed of a hard material providing structural integrity and allowing the utensil to easily slide along the bottom of a dish such as bowl or a plate and remove and serve the contents therein. Unfortunately, this prior art example does not include a means to conveniently switch between scooping solid and liquid foods and draining the fluids from foodstuffs contained therein.

Accordingly, a need remains for an adjustable food serving utensil in order to overcome the above-noted shortcomings. The present invention satisfies such a need by providing an apparatus that is simple and easy to use, is lightweight yet durable in design, and allows a user to effectively drain fluid from food contained within a food retaining section of the utensil by moving a switch conveniently located in the handle of the utensil. Alternatively, a user may use the utensil in a manner that retains fluid in the retaining section, or scoop dry food respectively. Such a utensil allows a user to quickly and efficiently switch between modes of operation simply by moving a switch conveniently located in the handle of the utensil. The present invention effectively does the work of two utensils, thus advantageously saving a user time and space.

BRIEF SUMMARY OF THE INVENTION

In view of the foregoing background, it is therefore an object of the present invention to provide an apparatus for an adjustable food serving utensil. These and other objects, features, and advantages of the invention are provided by an adjustable food serving utensil for use with solid and liquid foods.

The apparatus includes a body that has a handle conveniently located at a proximal end of the body and a food retaining section conveniently located at a distal end of the body respectively. Such a body has a hollow chamber effectively extending from the proximal end to the distal end of the body and is axially seated therein. The body is advantageously provided with a linear opening located adjacent to the proximal end thereof.

The apparatus further includes a manually-operable actuator switch effectively housed within the linear opening and linearly displaced parallel to a longitudinal length of the body. Such a switch has a flange portion conveniently protruding outwardly from a top surface of the handle such that a user may advantageously bias the switch between engaged and disengaged positions while holding the body in one hand. The actuator switch is displaced along a linear path equal to a longitudinal length of the slots (herein described below) respectively.

The apparatus further includes a shaft effectively housed within the hollow chamber and extending along a longitudinal length thereof. Such a shaft has a first end monolithically formed with the switch and further has a second end adjustably intercalated within the food retaining section. The shaft preferably has a unitary and singular rectilinear body that is advantageously housed within the hollow chamber.

The apparatus includes a food retaining section that has a concave top surface having a plurality of slots conveniently formed therein and penetrating a thickness of the food retaining section. Such slots are coextensively shaped and travel parallel to the actuator switch and the shaft respectively.

The apparatus further includes fingers that are monolithically formed with the second end of the shaft and are effectively displaced in sync therewith when the actuator switch is biased between the engaged and disengaged positions. Such a second end is permanently located within the food retaining section. Such fingers are removably and selectively interfitted within the slots such that fluids are effectively prevented from penetrating through the slots when the actuator switch is biased to an engaged position. The fingers are advantageously disposed within the food retaining section when the actuator switch is adapted to the engaged position, as well as, a disengaged position respectively. The fingers preferably have a lateral thickness substantially equal to a lateral thickness of corresponding ones of the slots such that the fingers are tightly nested within the slots when the switch is biased to an engaged position.

The apparatus further includes a mechanism for stabilizing the shaft such that the shaft is effectively prohibited from laterally oscillating away from the longitudinal axis of the hollow chamber during operating conditions. Such a stabilizing mechanism is advantageously spaced from the food retaining section. The stabilizing mechanism is directly engaged with the shaft and the body. The stabilizing mechanism preferably includes a plurality of bearings adjoining an outer surface of the shaft such that the bearings are rotatably intercalated within the hollow chamber. Such bearings are located at a point substantially equidistant between the first and second ends of the shaft such that first and second ends of the shaft are advantageously and equally balanced within the hollow chamber.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
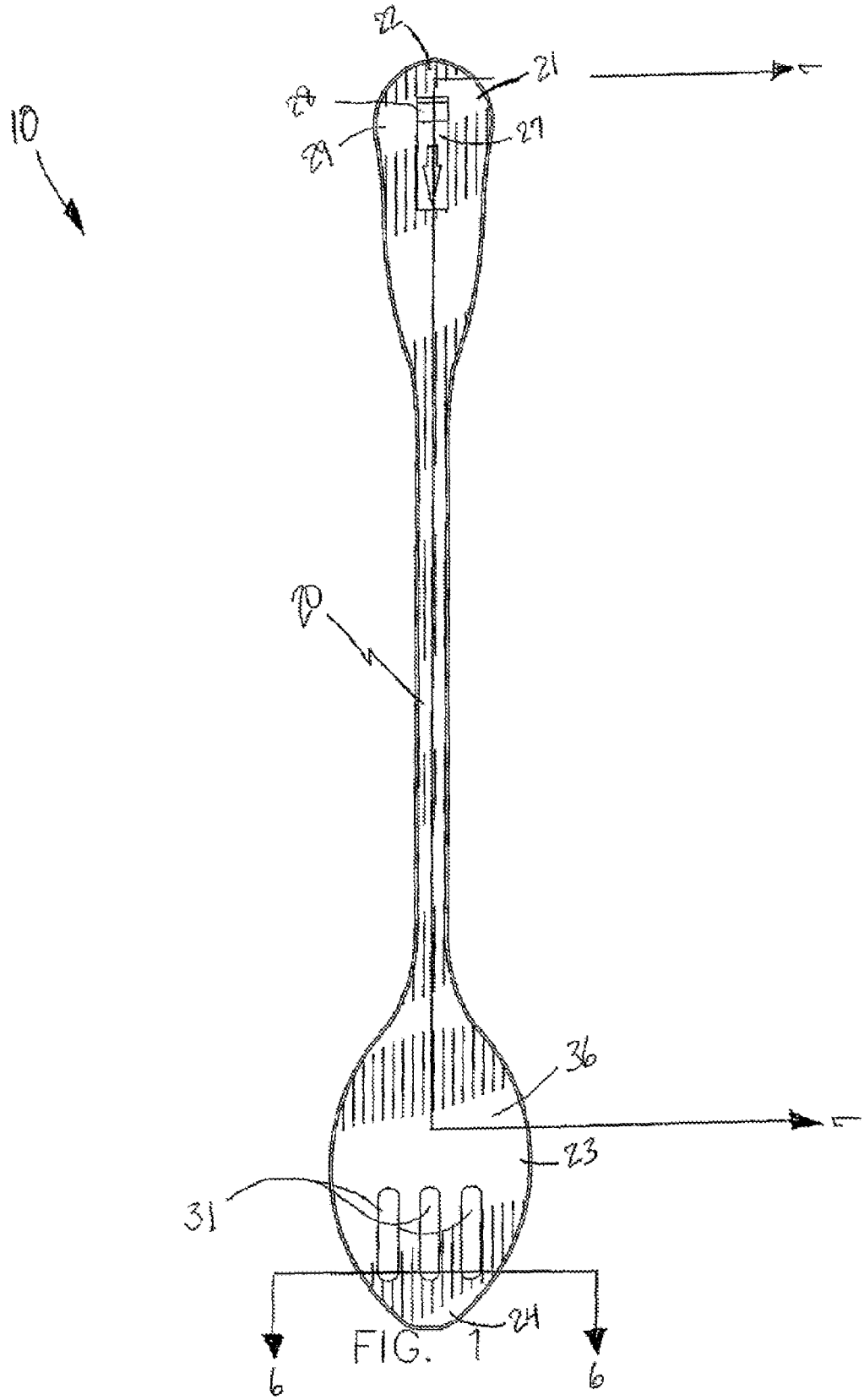
FIG. 1 is a top plan view showing an adjustable food serving utensil, in accordance with the present invention.
Figure 2:
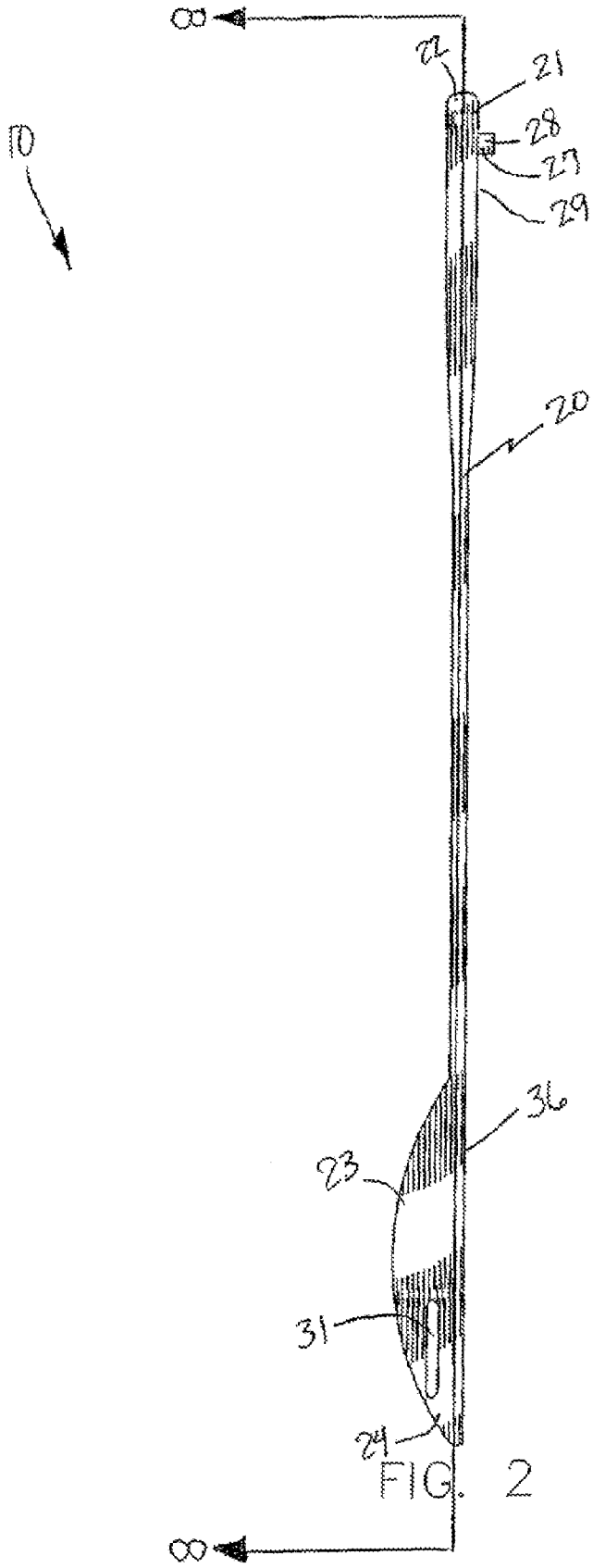
FIG. 2 is a side-elevational view of the apparatus shown in FIG. 1.
Figure 3:
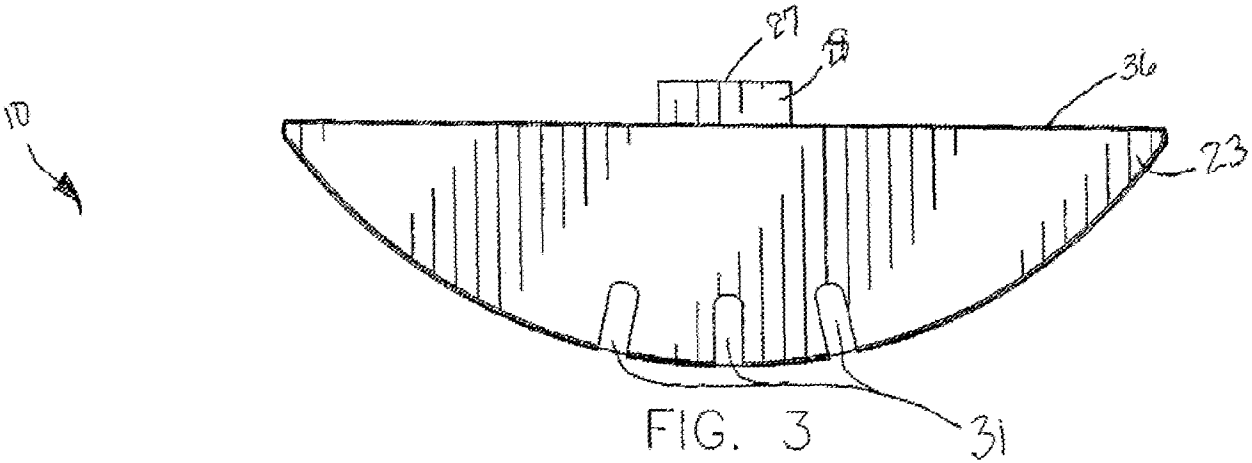
FIG. 3 is a front-elevational view of the apparatus shown in FIG. 1 taken from the distal end.
Figure 4:
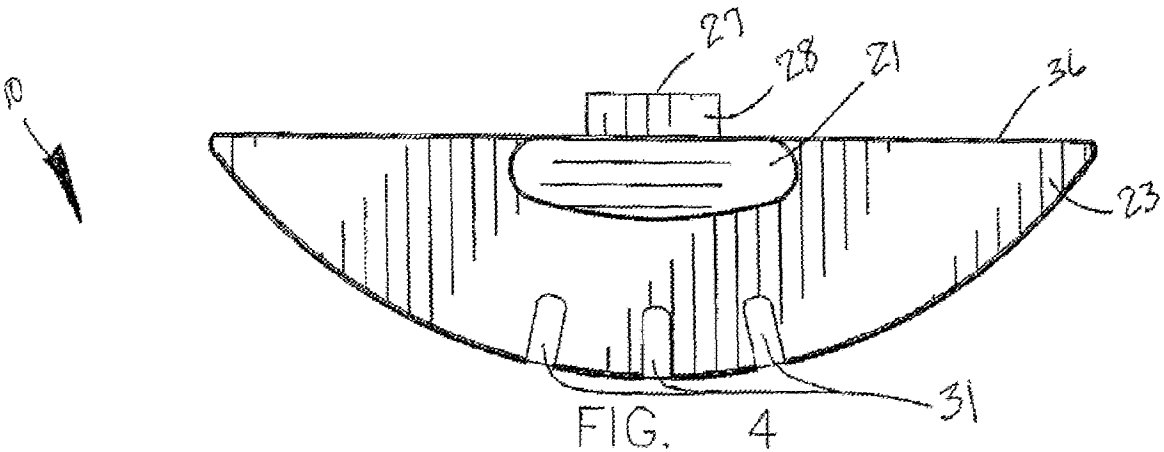
FIG. 4 is a rear-elevational view of the apparatus shown in FIG. 1 taken from the proximal end and showing the handle.
Figure 5:
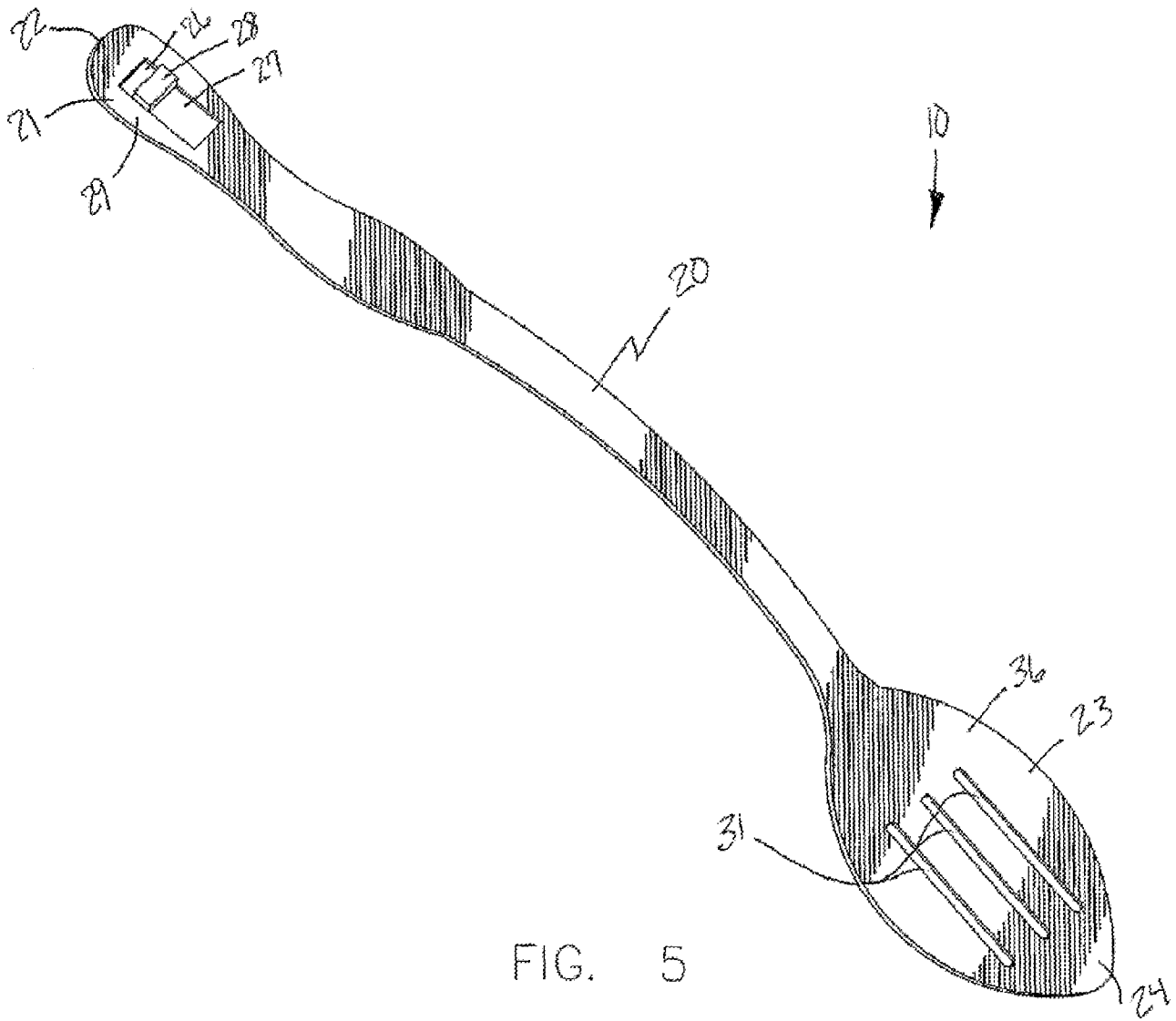
FIG. 5 is a perspective view of the apparatus shown in FIG. 1.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1-8 by the reference numeral 10 and is intended to provide an adjustable food serving utensil. It should be understood that the apparatus 10 may be used to serve many different types of food and should not be limited in use to serving only those types of food described herein.

Referring initially to FIGS. 1, 2, 3, 4, 5, 7 and 8, the apparatus 10 includes a body 20 that has a handle 21 conveniently located at a proximal end 22 of the body 20 and a food retaining section 23 conveniently located at a distal end 24 of the body 20 respectively, which is important for allowing a user to effectively scoop food with food retaining section 23 while keeping food from coming into contact with a user hand. Such a body 20 has a hollow chamber effectively extending from the proximal end 22 to the distal end 24 of the body 20 and is axially seated therein. The body 20 is advantageously provided with a linear opening 26 located adjacent to the proximal end 22 thereof. Of course, such a body 20 can be formed from a variety of suitable materials, as is obvious to a person of ordinary skill in the art.

Again referring to FIGS. 1, 2, 3, 4, 5, 7 and 8, the apparatus 10 further includes a manually-operable actuator switch 27 effectively housed within the linear opening 26 and linearly displaced parallel to a longitudinal length of the body 20. Such an actuator switch 27 has a flange portion 28 conveniently protruding outwardly from a top surface 29 of the handle 21, which is essential such that a user may advantageously bias the actuator switch 27 between engaged and disengaged positions while holding the body 20 in one hand. The actuator switch 27 is displaced along a linear path equal to a longitudinal length of the slots 31 (herein described below).

Figure 7:
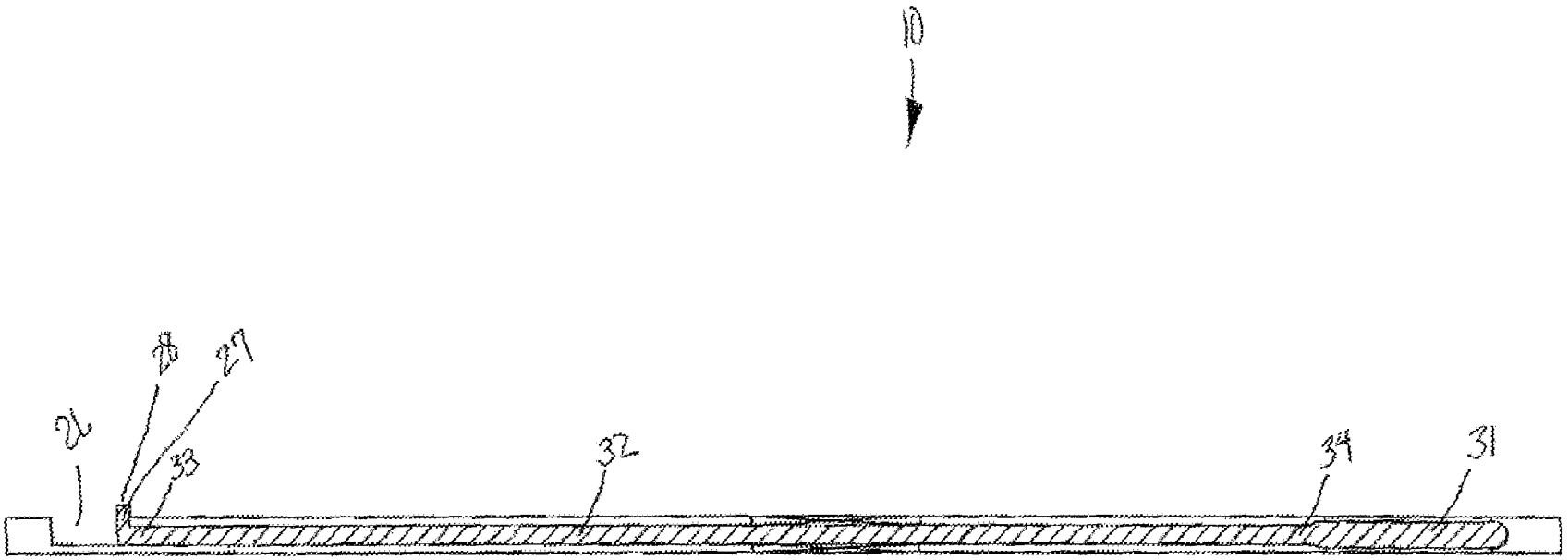
FIG. 7 is a cross-sectional view of the apparatus shown in FIG. 1 showing the actuator switch, shaft, stabilizing means and fingers taken along line 7-7.
Figure 8:
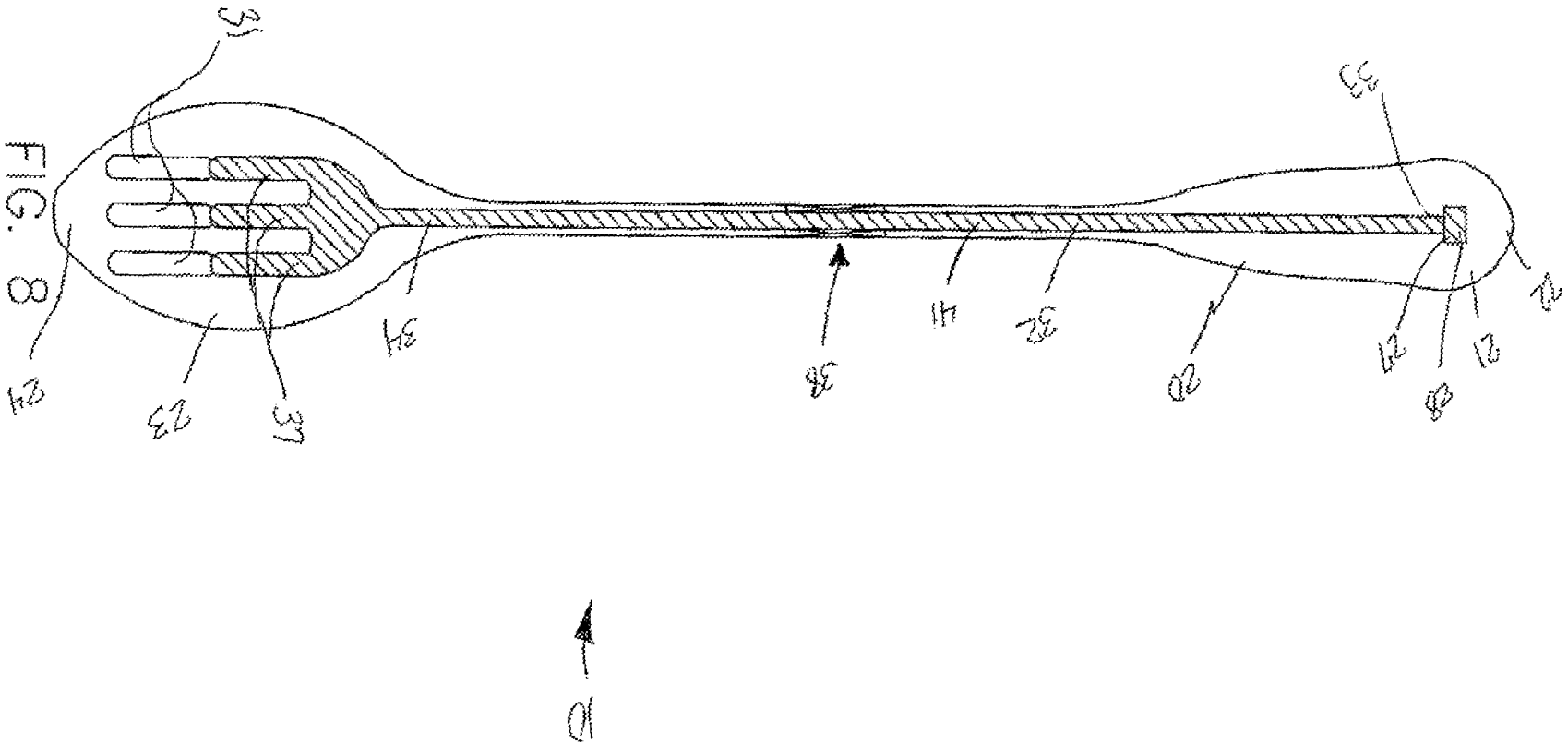
FIG. 8 is a cross-sectional view of the apparatus shown in FIG. 2 showing the actuator switch, shaft, stabilizing means and fingers in the disengaged position taken along line 8-8.

Referring to FIGS. 7 and 8, the apparatus 10 further includes a shaft 32 effectively housed within the hollow chamber and extending along a longitudinal length thereof. Such a shaft 32 has a first end 33 monolithically formed with the switch 27 and further has a second end 34 adjustably intercalated within the food retaining section 23. Such an associated structure is crucial such that the shaft 32 is effectively extended into and retracted from the food retaining section 23 respectively when the switch 27 is biased between engaged and disengaged positions. The shaft 32 has a unitary and singular rectilinear body 35 that is advantageously housed within the hollow chamber. Of course, such a shaft 32 can be produced from a variety of suitable materials, as is obvious to a person of ordinary skill in the art.

Referring to FIGS. 1, 2, 3, 4, 5, 6 and 8, the apparatus 10 includes a food retaining section 23 that has a concave top surface 36 having a plurality of slots 31 conveniently formed therein and penetrating a thickness of the food retaining section 23, which is vital such that fluids are allowed to drain from the food retaining section 23 during operating conditions. Such slots 31 are coextensively shaped and travel parallel to the actuator switch 27 and the shaft 32 respectively. Of course, such slots 31 can be formed in a variety of sizes and shapes, as is obvious to a person of ordinary skill in the art.

Figure 6:
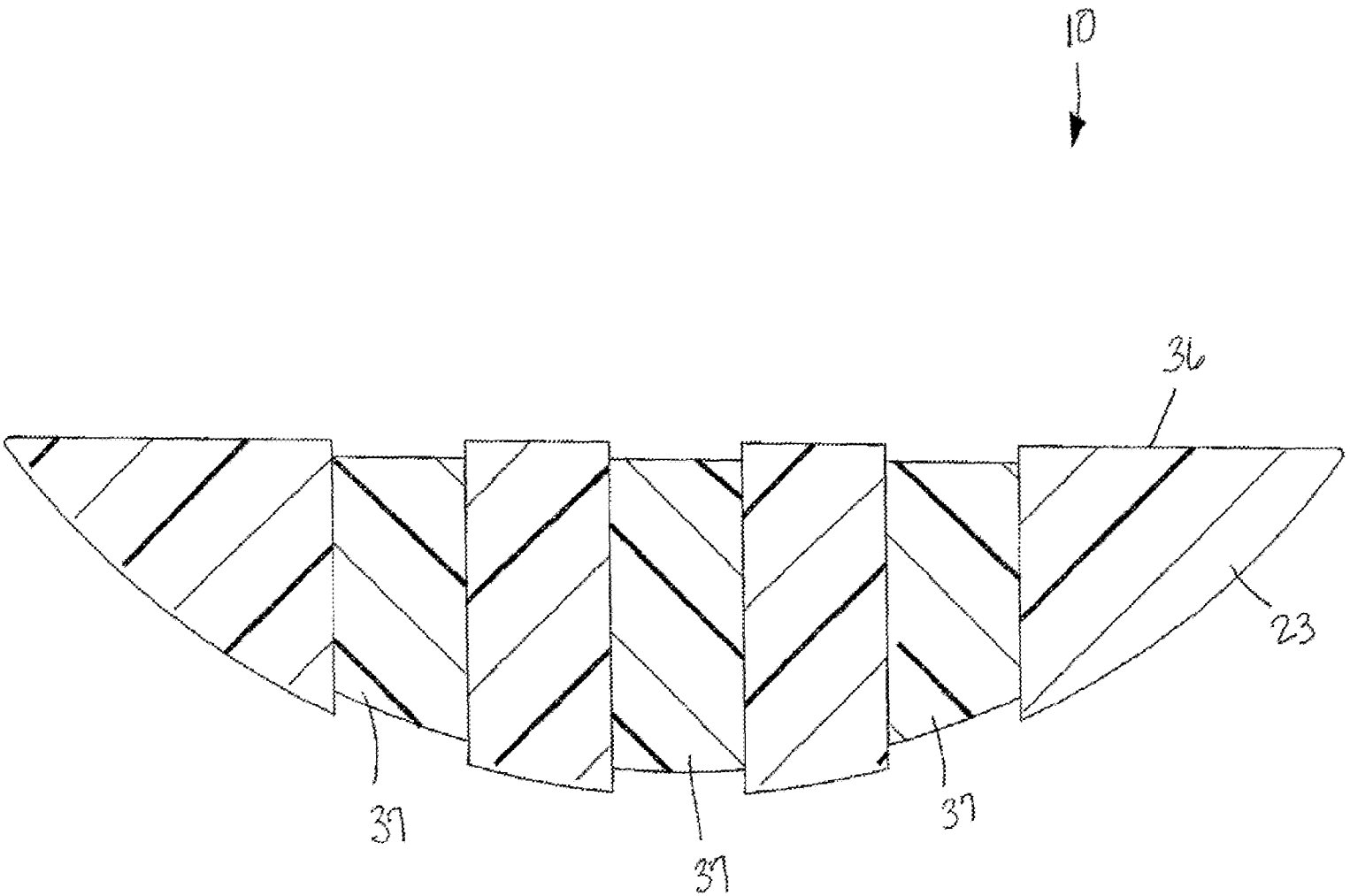
FIG. 6 is a cross-sectional view of the apparatus shown in FIG. 1 taken along line 6-6.

Referring to FIGS. 6, 7 and 8, the apparatus 10 further includes fingers 37 that are monolithically formed with the second end 34 of the shaft 32 and are effectively displaced in sync therewith when the actuator switch 27 is biased between the engaged and disengaged positions, which is critical such that fluids are drained or retained within the food retaining section 23 according to the desire of the user. Such a second end 34 is permanently located within the food retaining section 23. Such fingers 37 are removably and selectively interfitted within the slots 31 such that fluids are effectively prevented from penetrating through the slots 31 when the actuator switch 27 is biased to an engaged position.

The fingers 37 are advantageously disposed within the food retaining section 23 when the actuator switch 27 is adapted to the engaged position, as well as, a disengaged position respectively. The fingers 37 have a lateral thickness substantially equal to a lateral thickness of corresponding ones of the slots 31 such that the fingers 37 are tightly nested within the slots 31 when the actuator switch 27 is biased to an engaged position. Of course, such fingers 37 can be produced in a variety of suitable thicknesses, as is obvious to a person of ordinary skill in the art. The associated structure of the fingers 37 and the slots 31 allows fluids to be effectively prevented from draining from the food retaining section 23 according to the desire of the user.

Referring to FIGS. 7 and 8, the apparatus 10 further includes a mechanism 38 for stabilizing the shaft 32, which is essential such that the shaft 32 is effectively prohibited from laterally oscillating away from the longitudinal axis of the hollow chamber 25 during operating conditions. Such a stabilizing mechanism 38 is advantageously spaced from the food retaining section 23, which is critical such that food contained within the food retaining section 23 is prevented from contacting the stabilizing means 38 during operating conditions, and thus interfering with the proper function thereof. The stabilizing mechanism 38 is directly engaged with the shaft 32 and the body 20, without the use of intervening elements.

Still referring to FIGS. 7 and 8, the stabilizing mechanism 38 includes a plurality of bearings adjoining an outer surface 41 of the shaft 32 such that the bearings are rotatably intercalated within the hollow chamber, which is crucial for allowing the shaft 32 to be biased to engaged and disengaged positions in a smooth manner. Of course, such bearings can be produced in a variety of sizes and from any suitable material, as is obvious to a person of ordinary skill in the art. Such bearings are located at a point substantially equidistant between the first 33 and second 34 ends of the shaft 32, which is vital such that first 33 and second 34 ends of the shaft 32 are advantageously and equally balanced within the hollow chamber. Such a balance allows for pressure to be evenly distributed along the shaft 32, thus advantageously reducing the possibility of a malfunction of the stabilizing mechanism 38 during operating conditions.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. An adjustable food serving utensil for use with solid and liquid foods, said food serving utensil comprising:

a single and unitary body including a handle located at a proximal end of said body and a food retaining section located at a distal end of said body respectively, said body having a hollow chamber extending from said proximal end to said distal end of said body and axially seated therein, wherein said body is provided with a linear opening located adjacent to said proximal end thereof, said hollow chamber spanning along a major longitudinal length of said body;

a manually-operable actuator switch housed within said linear opening and linearly displaced parallel to a longitudinal length of said body, said switch having a flange portion protruding outwardly from a top surface of said handle such that a user may bias said switch between engaged and disengaged positions while holding said body in one hand;

a shaft housed within said hollow chamber and extending along a major longitudinal length thereof such that said shaft extends from said distal end of said body to said proximal end of said body, said shaft having a first end monolithically formed with said switch and further having a second end adjustably intercalated within said food retaining section; and means for stabilizing said shaft such that said shaft is prohibited from laterally oscillating away from the longitudinal axis of said hollow chamber during operating conditions, said stabilizing means being spaced from said food retaining section, wherein said stabilizing means is directly engaged with said shaft and said body;

wherein said stabilizing means comprises a plurality of bearings adjoining an outer surface of said shaft and being rotatably intercalated within said hollow chamber, said bearings being located at a point substantially equidistant between said first and second ends of said shaft such that first and second ends of said shaft are equally balanced within said hollow chamber;

wherein said food retaining section includes a concave top surface having a plurality of slots formed therein and penetrating a thickness of said food retaining section, said slots being coextensively shaped and traveling parallel to said actuator switch and said shaft respectively wherein said actuator switch is displaced along a linear path equal to a longitudinal length of said slots respectively, each of said slots having axially opposed closed ends disposed inwardly from an outer perimeter of said top surface, said outer perimeter of said food retaining section having a curvilinear distal-most tip spaced distally from distal most tips of said slots respectively.

2. The food serving utensil of claim 1, wherein said shaft has a unitary and singular rectilinear body provided with a plurality of fingers and housed within said hollow chamber, said fingers being removably and selectively interfitted within said slots such that fluids are prevented from penetrating through said slots when said actuator switch is biased to an engaged position, said fingers being disposed within said food retaining section when said actuator switch is adapted to the engaged position as well as a disengaged position respectively.

3. The food serving utensil of claim 2, wherein said fingers are monolithically formed with said second end of said shaft and are displaced in sync therewith when said actuator switch is biased between the engaged and disengaged positions, said second end being permanently located within said food retaining section.

4. The food serving utensil of claim 2, wherein said fingers have a lateral thickness substantially equal to a lateral thickness of corresponding ones of said slots such that said fingers are tightly nested within said slots when said switch is biased to an engaged position.

* * * * *